US005449548A

United States Patent [19]

Bowen, Jr.

[11] Patent Number: 5,449,548

[45] Date of Patent: Sep. 12, 1995

[54] TABLE, REDUCED PERMEABILITY PAPERMAKER'S FABRICS CONTAINING FIBERS WITH FINS DESIGNED TO DISTORT AT LOWER FORCE LEVELS BY HAVING A REDUCED CROSS SECTIONAL AREA WITHIN THE FIN

[76] Inventor: David Bowen, Jr., 9349 Old A1A, St. Augustine, Fla. 32086

[21] Appl. No.: 346,539

[22] Filed: Nov. 28, 1994

[51] Int. Cl.[6] ..... D03D 3/00

[52] U.S. Cl. ..... 428/229; 139/383 A; 162/902; 428/225; 428/257

[58] Field of Search ..... 428/257, 225, 229; 139/383 A; 162/902

[56] References Cited

U.S. PATENT DOCUMENTS 4,381,612 5/1983 Shank ..... 34/116
4,633,596 1/1987 Josef ..... 34/116
5,097,872 3/1992 Laine et al. ..... 139/426 R
5,361,808 11/1994 Bowen ..... 139/383 A
5,364,692 11/1994 Bowen et al. ..... 428/222

*Primary Examiner*—James J. Bell

[57] ABSTRACT

A woven or spiral papermaker's or industrial fabric characterized in that at least a portion of its fibers have two or more thin fins, some of which fins are designed for ease of flexing or compression by incorporation of a reduced cross section "hinge" area or by a variation in thickness of more than 20 per cent as a function of distance from the fiber center. This will achieve interlocking between crossing fibers at significantly reduced "beat-up" force in weaving or less shrinkage force in spiral fabrics. By remaining extended where there is no fiber to fiber crushing action, the fins fill the fabric interstitial spaces and control fabric porosity. Significant cost and quality benefits are achieved.

8 Claims, 2 Drawing Sheets

TABLE, REDUCED PERMEABILITY PAPERMAKER'S FABRICS CONTAINING FIBERS WITH FINS DESIGNED TO DISTORT AT LOWER FORCE LEVELS BY HAVING A REDUCED CROSS SECTIONAL AREA WITHIN THE FIN

BACKGROUND OF THE INVENTION

In the preparation of paper, woven and spiral fabric belts are utilized to support the cellulosic pulp fibers as they are moved through the papermaking process and converted from a thin slurry into finished paper. It has been found that mechanical stability and permeability control of these belts is critical to the production of consistent, high quality paper. As paper machine speeds have increased, fabrics designed for use in the dryer sections of papermaking machines have had their targeted permeability reduced from 500 cubic feet per miracle per square foot; with a pressure differential of one half inch of water to 100 or less. There has also been a trend toward use of thinner fabric constructions to minimize differential forces on the paper as it passes over and under the belts in certain process steps. For woven fabrics, these two papermaker's fabric requirements are in conflict since the common way to reduce permeability is to increase size of the weft yarn or the number of picks per inch, both of which can result in increased fabric thickness. Increased beat-up forces are required to force wefts into these fabric designs For the desired low permeability products. These high beat-up forces lead to fiber and machine damage. For spiral fabrics, ribbon and X shaped yarns have been developed to insert into the open areas of the fabric design. These designs give satisfactory permeability results, but require very careful size control and relatively high force levels for insertion into the fabric and prevention of fabric distortion.

DESCRIPTION OF THE PRIOR ART

As the demand for papermaker's and industrial fabrics has moved toward thinner, reduced permeability fabrics, suppliers of such fabrics have shifted from use of round monofilament wefts to use of twisted and cabled yarn constructions which have more capability to conform into the interstitial spaces formed at the crossings of warp and weft yarns. This switch has been moderately successful in regards to production of lower permeability and improved fabric stability. Some negative results of this practice are that the smaller monofilaments used in cabled constructions are more easily damaged by severe environmental exposure and that cabled yarns tend to become contaminated with process "tars" faster than true monofilament wefts. The extra handling and processing stages required to produce these twisted and cabled yarns also makes their cost significantly higher than that of monofilament.

There has also been a shift toward use of more ribbon-like warp yarns. These warps give improved paper contact and decrease the number of interstices, thus resulting in reduced fabric permeability. Reduction in the number of interstices has had a negative impact on fabric stability since interactions at fiber intersections lock the fabric together. Wear due to the thin profile of ribbon warp yarns has also been a drawback to more widespread use of this concept.

Fabric stability is improved by increasing the interaction between warp and weft yarns. As each weft pick is inserted into the fabric, it is beaten against the warp so that the warp takes on a sinusoidal crimp, The weft remains relatively flat, and the distortion created at the mechanical intersection of the warp and weft contributes significantly to fabric stability. Current methods of improving stability include increasing pick count, use of multifilament warps and/or wefts, use of cabled weft yarns, and application of resinous fabric treatments. Each of the listed methods is acceptable in selected areas, but all carry a cost or performance penalty which prevent them from being generally acceptable.

In U.S. Pat. No. 5,097,872, Laine et, al. teach the use of an X shaped fiber to achieve improved fabric stability, but their application requires almost complete flattening of the fiber on one side by bending forces and the design use described would not contribute to improved permeability control. There is no mention or inferred concept for hinged or variable cross sections in the arms of the X. In contrast, the current patent application requires that some of the finned extensions have a decreased cross sectional area along their length to make them easier to bend arid distort during weaving. Forces due to both bending and fiber compression during "beat-up" are present in the weaving process. Where bending or contact forces are not present, the fins will remain erect to block fabric interstitial spaces.

In U.S. Pat. No. 4,633,596, Josef teaches the use of warp fibers having a center thinner than the edges and which improves fabric dimensional stability by minor distortion at warp and weft crossings. This is in marked contrast to the use of finned and hinged weft and stuffer fibers which run in the cross machine direction in woven and spiral fabrics. Designs shown would not crush or easily distort duping weaving. Josef also makes no claim or mention related to spiral fabrics. The drawings and discussion of Josef's patent tend to lead toward production of fabric designs targeted toward high permeability fabrics.

In U.S. Pat. No. 5,361,808, Bowen teaches the use of finned weft fibers which deflect at the intersections of the warp and weft, but which fins remain extended to block fabric interstitial space where not mechanically contacted by other fibers. Fin length and use of plasticizers are the mechanisms described to promote flexibility.

In U.S. Pat. No. 5,364,692, Bowen and Smith teach the use of T, X, or v shaped stuffer yarns to reduce permeability of spiral fabrics. No special shape of mechanism to produce "arms" with reduced stiffness to bending forces is disclosed. This application contrasts significantly by specifying that the arms or fins of the shaped fiber contain a reduced cross sectional area designed to promote bending at force levels one half or less of that which would be required if the fin had a uniform cross section.

In U.S. Pat. No. 4,381,612, Shank describes spiral fabrics containing one or more stuffer filaments, but describes no technology or intent to design the stuffer filaments to allow for easy distortion and conformation into the free spaces of the fabric during fabric sizing and heatsetting.

SUMMARY OF THE INVENTION

The present invention provides thin, stable, controlled permeability papermaking or industrial fabrics, especially dryer fabrics, with the capability of being easily produced on standard industrial looms or spiral fabric lines. Special advantage is achieved in manufacture of fabric designs with permeability targets of less than 175 cubic feet per minute per square foot with a pressure differential of one half inch of water. Fabrics utilizing this invention also have improved dimensional stability over that achieved by the now common use of twisted and plied monofilament wefts in weaving or simple unshaped fins in weaving and spiral fabric production.

Specifically, this invention provides, in a papermaker's fabric, the improvement wherein some or all of the yarns contain filaments designed to flex and distort at reduced fiber to fiber force levels by having two or more finned extensions, some of which extensions are characterized by incorporating a reduced cross section "hinge" area and/or a variable thickness from the center outward. For the purpose of this discussion, a yarn may consist of one or more filaments, but the preferred embodiment of this invention will be a monofilament. A reduction in cross sectional area of 20 per cent or more anywhere along the fin except for the normal radius at the fin terminus will be considered to meet the reduced cross section specification. Since the force required to obtain deformation is proportional to the cube of Fin thickness or width, a reduction of 20 per cent in fin thickness results in approximately a fifty per cent reduction in "beat up" force required to mold the yarn into the fabric. Advantage of the lower mechanical stress requirement can be taken to increase interlocking of the fibers while simultaneously reducing damage due to warp tensions and "beat up" forces. In production of spiral fabrics, increased flexibility of these shaped or hinged fins significantly reduce the forces required for insertion into the open segments of the design. When the spiral fabric shrinks in heatsetting, the flexible fin designs are interlocked into the fabric with minimum distortion of the fabric surface while simultaneously providing the desired reduced air permeability. For most fabric products, the best design will be a monofilament yarn between 400 and 3000 denier, but use multifilaments with uniform or mixed cross section designs is possible. Multiple filament yarn designs can be utilized to achieve specific fabric properties including permeability, thickness and stability. The filaments which make up these multifilament yarns will have a denier of more than 100, preferably 200 to 1500, and when combined into multifilaments will usually have low twist levels. These yarns can be utilized in the warp, weft or filling of industrial fabrics. Any appropriate polymer type and additive package used to produce yarns for papermaker's industrial fabrics may be used. Significant economic benefits are realized due to reduced denier of these yarns over other yarns previously used for this service.

BRIEF DESCRIPTION OF THE DRAWINGS

FIG. 3 shows a fin with stepped area reduction while

Figure 1:
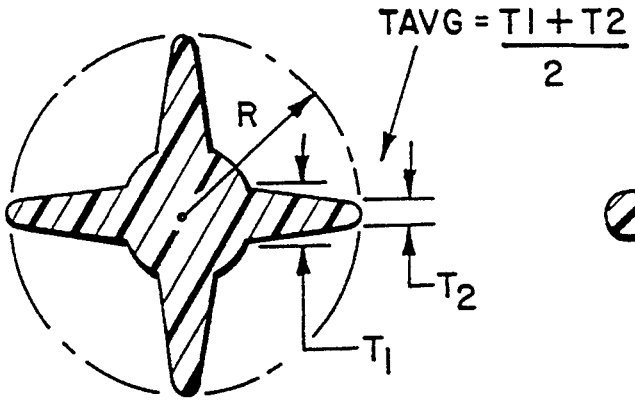
FIG. 1 is a cross sectional perspective view of the preferred embodiment for a filament having fins with a radially reducing cross sectional area.
Figure 2:
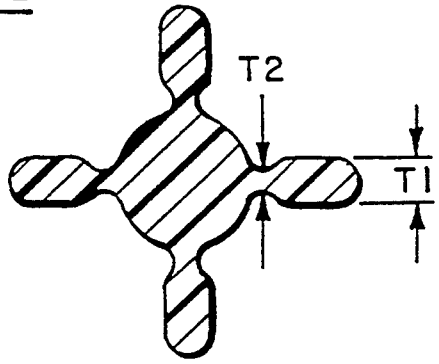
FIG. 2 is a cross sectional perspective view of the preferred embodiment for a filament having the "hinged" fin concept of the invention.
Figure 3:
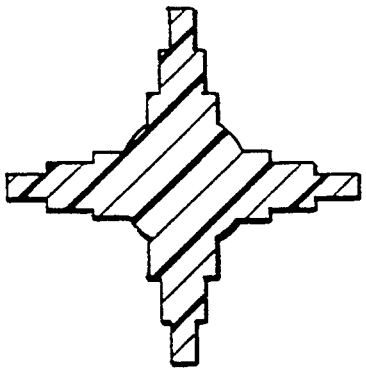
Figure 4:
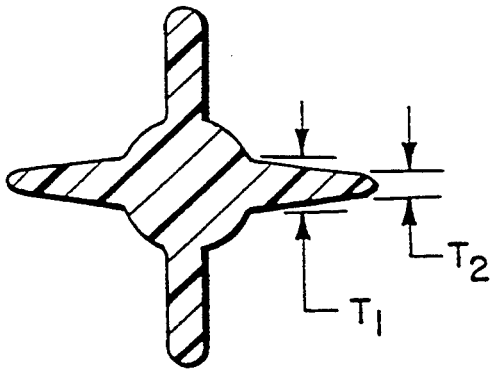
FIG. 4 shows a combination of fins with and without reduced area cross sections.
Figure 5:
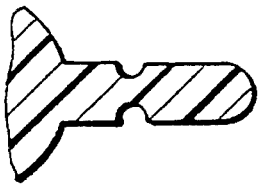
FIGS. 5, 6, and 7 show fins with mid hinge, curved area reduction and straight area reduction respectively.
Figure 6:
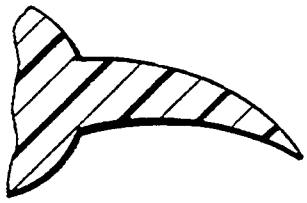
Figure 7:
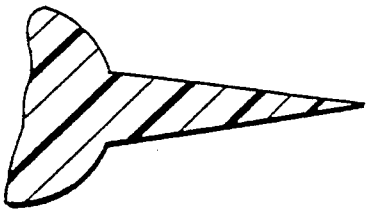

On FIGS. 1, 2 and 4, the fin thickness at T1 and T2 are those measurements where the reduction in thickness ratio would typically be calculated. If T2 divided by T1 is less than 0.8, the fin will fall within the specification of this invention. It is specifically pointed out that the normal rounding or radius effect at the end of such a fin is not considered to be a "manufactured" reduction except for a design such as that of the "ball" fin. For a special case such as this, the maximum radius will be used as the denominator in the calculation of fin cross sectional area reduction.

DETAILED DESCRIPTION OF THE INVENTION

The finned filaments used in the present invention can be prepared from a variety of thermoplastic materials. Polyethylene terphthalate, polyphenylene sulphide and 1,4-polydicyclohexanol terphthlate are currently widely used but not the only materials which might be chosen. In order to obtain the desired fin flexibility, these new yarn designs often require addition of polymer specific plasticizing agents during the filament extrusion process. Use of standard additive recipes which may include heat and hydrolysis stabilizers, contaminant release agents, and other such processing aids common to production of papermaker's yarns is considered as standard.

Modifications to customary techniques for filament production are required in order to achieve acceptable filament smoothness and uniformity for these new yarn shapes. This is caused by the overall filament width to fin thickness ratio necessary to obtain flexibility without fracture. This is where the concept of hinged or variable cross section fins excell over prior art. The taper or hinge results in a mope flexible fin which reduces the need for excessive plasticizing agents or extra lone fins. If the shape factor can be characterized by the ratio of the overall filament diameter divided by the average fin thickness, then filaments with a shape factor of from 3.5 to 20 can be used for these fabrics. The average fin thickness can be calculated by standard mathematical techniques. One such example is given for FIG. 1 where $TAVG=(T1+T2)/2$. R divided by TAVG is the shape factor considered fop the purpose of this invention. It is desireable to have the lowest possible shape factor in order to reduce surface to volume ratio of the fiber and thereby decrease damage due to difussion controlled degradation processes. For reasons of practicality, the number of fins will range from two to twelve.

Figure 8:
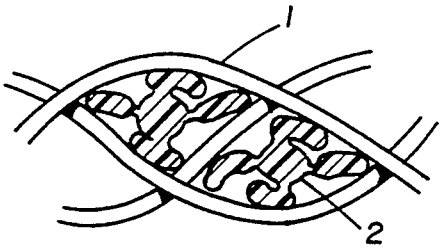
FIGS. 8 and 9 show distortion of the hinged and reducing cross section fins as the are woven into the fabric.
Figure 9:
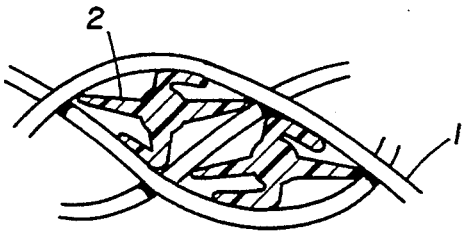
Figure 10:
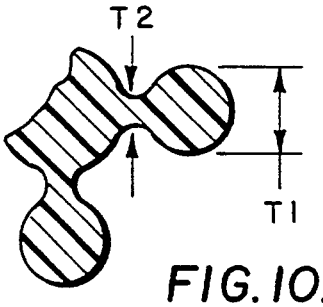
FIG. 10 shows a special "ball" fin design.
Figure 11:
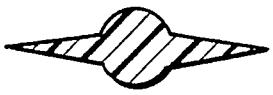
FIGS. 11 and 12 show two and eight fin fiber designs to indicate some of the variety which can be produced by this concept.
Figure 12:
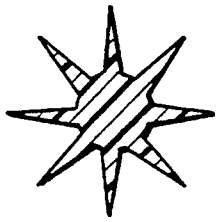

Fabrics are woven from these new variable fin cross section yarns in the same manner as with round, ribbon or twisted and plied fiber constructions currently in common use. In FIGS. 8 and 9, warp yarn is shown as 1 and weft yarn as 2. Bending of the weft fins by the warp during weaving is shown. FIG. 8 shows a fabric cross section showing use of all hinged tinned weft yarns. The important concept here is that the deformable fins easily conform to fill the available volume between the warp yarns and by so doing, lock the woven structure together and significantly reduce the openness of the fabric. Wefts containing less than four finned extensions are often found to be sensitive to the slight twist inserted into the weft as it is supplied to the process over the top of supply bobbins. This twist insertion results in small surface and permeability irregularities which can be significant in critical product areas. The X design has been found to very closely match the rectangular or diamond open area common to most weave patterns and is also a very good compromise for economy of material and ease of water removal during spinning. Use of more than four lobes reduces the importance of weft yarn orientation in the fabric, but at a cost of more monofilament extrusion difficulty. The physical size of the filament or fiber design will be determined by the cross sectional shape chosen, the flexibility designed into the fins, the target fabric thickness and size of the chosen companion warp or weft. FIG. 9 shows a fabric design similar to FIG. 8, but containing a weft yarn with a gradually reducing cross section rather than hinged weft yarns. The formation of large numbers of small fin distortions per inch of width during fabric production provides significant lateral stability and rigidity to products containing these flexibly finned fibers. Filaments of this type can be used in the warp, but their advantages are currently mote easily achieved in weft or stuffer yarn applications. Warp fibers with fins located to one side of the yarn so that the fins would be turned toward the interior of the woven fabric would be one example of a design which would be suitable for this patent concept.

Figure 13:
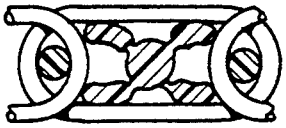
FIGS. 13, 14 and 15 show spiral fabric designs demonstrating the hinged fin concept.
Figure 14:
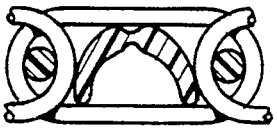
Figure 15:
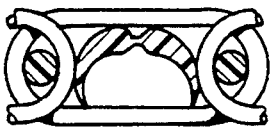
Figure 16:
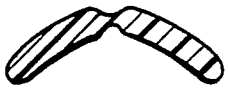
FIGS. 16 and 17 show arched and crescent filament designs which would be especially useful in spiral fabrics, but which also could be used in woven products.
Figure 17:
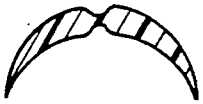

FIG. 13 shows a hinged stuffer yarn inserted into the formerly open area of a spiral fabric design. Size of the yarn is carefully controlled so that it may be easily inserted into the fabric open areas prior to heatsetting. FIGS. 14 and 15 show preferred embodiments of the concept for spiral fabrics. A crescent shaped stuffer yarn has been inserted into the open area of the fabric design and has been compressed into the upper and lower surfaces during heatsetting where shrinkage of the spirals under tension flattens the fabric, distorts the fins and locks the fabric together. If the fins are easily distorted, the fabric surface will remain smooth and flat. Permeability control may be achieved by inserting these special stuffer yarns into selected open areas or for another example, by alternating between yarns of this invention and other yarn types. For economy of production and material, the use of arched and crescent shaped designs with hinge areas are the preferred embodiment of the invention for spiral products.

In summary, the fibers of the invention will preferably be monofilaments between 400 and 3000 denier, have two to twelve finlike extensions, some of which extensions have variable cross sectional area designed to promote bending at reduced force relative to the force which would have been required if the fin cross section were uniform. In order to make this force reduction significant, design criteria have been chosen to allow for a 50 per cent force decrease by having a cross sectional width reduction of more than 20 per cent. Multifilament fiber designs can be used, with the finned filaments of such designs having a denier of between 200 and 1500 and some of which filaments contain variable area fins designed to promote bending. The fibers can be used in either the warp, weft or filling of papermaker's or industrial fabrics which can be either woven or spiral designs.

What is claimed is:

1. A woven papermaker's fabric characterized by having more than 90 percent of its yarns between 400 and 5000 denier, said yarns consisting of monofilaments or low twist multifilament yarns with component filaments larger than 200 denier, wherein all or a portion of the yarns contain modified finned fibers which have a shape factor of 3.5 to 10 and which are designed for interlocking at one half or less of the production or heatsetting force levels required for fabrics with unmodified finned fibers, said modified finned fibers containing two or more fins, some of which fins are designed to distort at these lower Force levels by incorporation of one or more locations within the fin profile cross section with a more than a 20 per cent reduced cross sectional "hinge" or bending area or by a more than 20 per cent variation in cross sectional thickness as a function of distance from the fiber center.

2. The woven fabric of claim 1, wherein all or a portion of the weft yarn only is characterized by having filaments with fins, some of which fins are designed for distortion at one half or less of the fiber to fiber force levels required in production of fabrics containing fibers with unmodified fins, said fin modification consisting of having one or more locations in the fin cross sectional area profile with an area reduction of at least 20 per cent.

3. The woven fabric of claim 1, wherein more than 60 per cent of the yarns are monofilaments.

4. The woven fabric of claim 1 where the fin "hinge" is located between the central edge of the fin and the middle of the fin.

5. The woven fabric of claim 1 where the warp yarn is designed with hinged or tapered fins which project inwardly from the upper or lower plane of the fabric.

6. A spiral papermaker's fabric characterized in that some or all of the open spaces formed between the joining or axle fibers of the structure and the spiral coils are stuffed with monofilaments larger than 7300 denier, having a shape factor of 4 to 12, with two to eight finned extensions, a portion of which extensions have been designed to distort at one half or less of the force level required for a fin with uniform cross sectional area by incorporating a more than 20 per cent reduced cross sectional "hinge" area somewhere along the fin length, thereby producing smooth interlocked fabrics with reduced permeability during heatsetting.

7. A spiral papermaker's fabric characterized in that some or all of the open spaces between the axle fibers of the coiled structure are stuffed with crescent or arched shaped monofilaments larger than 250 denier.

8. The papermaker's fabric of claim 7 where some or all of the open spaces between the axle fibers are stuffed with crescent or arched shaped monofilaments larger than 250 denier which have been designed to bend and distort at force levels of one half or less or that required by uniform profile fibers by having one or several 20 per cent cross sectional area reductions within their profile.

* * * * *

UNITED STATES PATENT AND TRADEMARK OFFICE

CERTIFICATE OF CORRECTION

PATENT NO. : 5,449,548

DATED : September 12, 1995

INVENTOR(S) : Bowen, Jr.

It is certified that error appears in the above-indentified patent and that said Letters Patent is hereby corrected as shown below:

On the title page: Item [54] and Column 1, line 1

The title of the invention reads: "(Table), Reduced---"
It should read: "Stable, Reduced-----"

Column 2, line 34 reads: "crush or easily distort (duping) weaving. Josef also makes". It should read: "crush or easily distort during weaving. Josef also makes"

Column 3, line 39 reads: "ment yarn between 400 and 3000 denier, but use multi-". It should read: "ment yarn between 400 and 3000 denier, but use of multi-".

UNITED STATES PATENT AND TRADEMARK OFFICE

CERTIFICATE OF CORRECTION

PATENT NO. : 5,449,548

DATED : September 12, 1995

INVENTOR(S) : Bowen, Jr.

It is certified that error appears in the above-indentified patent and that said Letters Patent is hereby corrected as shown below:

Column 6, line 6, claim 1 reads: "having more than 90 per cent of its yarns between (400)". It should read: "having more than 90 percent of its yarns between 200".

Column 6, line 9, claim 1 reads: "ments larger than (200) denier, wherein all or a portion of". It should read: "ments larger than 100 denier, wherein all or a portion of".

Column 6, line 43, reads: "are stuffed with monofilaments larger than (7300) denier,". It should read "are stuffed with monofilaments larger than 300 denier".

Signed and Sealed this

Twentieth Day of February, 1996

*Attest:*

*Attesting Officer*

Bruce Lehman

BRUCE LEHMAN

*Commissioner of Patents and Trademarks*